US011957260B2

(12) United States Patent
House et al.

(10) Patent No.: US 11,957,260 B2
(45) Date of Patent: Apr. 16, 2024

(54) SIDE SLEEPER SLEEPING BAG

(71) Applicant: Big Agnes, Inc., Steamboat Springs, CO (US)

(72) Inventors: Sally House, Oak Creek, CO (US); Paige Baker, Steamboat Springs, CO (US)

(73) Assignee: BIG AGNES, INC., Steamboat Springs, CO (US)

( * ) Notice: Subject to any disclaimer, the term of this patent is extended or adjusted under 35 U.S.C. 154(b) by 125 days.

(21) Appl. No.: 17/665,470

(22) Filed: Feb. 4, 2022

(65) Prior Publication Data

US 2022/0248881 A1 Aug. 11, 2022

Related U.S. Application Data

(60) Provisional application No. 63/146,061, filed on Feb. 5, 2021.

(51) Int. Cl.
*A47G 9/08* (2006.01)
*A47G 9/00* (2006.01)

(52) U.S. Cl.
CPC ..... *A47G 9/086* (2013.01); *A47G 9/08* (2013.01)

(58) Field of Classification Search
CPC ..... A47G 9/086; A47G 9/08
USPC ..... 5/413 R, 413 AM
See application file for complete search history.

(56) References Cited

U.S. PATENT DOCUMENTS 3,924,273 A * 12/1975 Donovan ..... A41D 13/00 5/413 R
3,959,834 A 6/1976 Hunt
4,125,910 A * 11/1978 Nicholai ..... A41D 15/04 2/69.5
4,507,805 A * 4/1985 Calutoiu ..... A41D 15/04 5/413 R
4,787,105 A 11/1988 Phillips et al.
4,884,303 A * 12/1989 Scherer ..... A47G 9/086 5/413 R
5,657,497 A * 8/1997 Howe ..... A47G 9/086 5/413 R (Continued)

FOREIGN PATENT DOCUMENTS

WO 2019246260 A1 12/2019

OTHER PUBLICATIONS

"Best Sleeping Bags for Side Sleepers (With 4 Buying Tips)" downloaded from https://www.tryoutnature.com/sleeping-bags-for-side-sleepers/ on Dec. 3, 2019.

(Continued)

*Primary Examiner* — Robert G Santos
(74) *Attorney, Agent, or Firm* — HOLZER PATEL DRENNAN

(57) ABSTRACT

A sleeping bag that allows a user to comfortably sleep on their side without their sleeping bag twisting or otherwise hindering their ability to rest and sleep. The sleeping bag has an increased amount of insulation in one or more of the hip region, the shoulder region, and the footbox as compared to the torso region and the leg region. The sleeping bag may have two different types of insulation in the region having the increased amount of insulation versus one type of insulation in the other areas of the bag.

19 Claims, 8 Drawing Sheets

(56) References Cited

U.S. PATENT DOCUMENTS

| | | | | |
|---|---|---|---|---|
| 5,966,756 | A * | 10/1999 | Cartier | A47G 9/086 5/413 R |
| 6,175,976 | B1 * | 1/2001 | Cantwell | A47G 9/086 5/413 R |
| 6,449,787 | B1 * | 9/2002 | Thorne | A47G 9/086 5/413 R |
| 8,166,572 | B1 * | 5/2012 | Campbell | A47G 9/086 5/413 R |
| 8,499,381 | B1 | 8/2013 | Miller et al. | |
| 8,707,479 | B2 * | 4/2014 | Benninger | A47G 9/086 5/413 R |
| 8,955,177 | B2 * | 2/2015 | Benninger | A47G 9/086 5/413 R |
| 9,101,233 | B2 * | 8/2015 | Benninger | A47G 9/08 |
| 9,408,484 | B2 | 8/2016 | Schofield et al. | |
| 9,848,689 | B2 | 12/2017 | Brensinger et al. | |
| 2013/0177731 | A1 * | 7/2013 | Moriarty | B32B 27/12 5/413 R |
| 2014/0013506 | A1 * | 1/2014 | Benninger | A47G 9/086 5/413 R |
| 2014/0230148 | A1 * | 8/2014 | Benninger | A47G 9/086 5/413 R |
| 2014/0345051 | A1 * | 11/2014 | Benninger | A47G 9/086 5/413 R |
| 2022/0248881 | A1 * | 8/2022 | House | A47G 9/086 |

OTHER PUBLICATIONS

Pearson, Stephanie, "What's the best sleeping bag for a side sleeper?" published Oct. 30, 2009; downloaded from https://www.outsideonline.com/1768941/whats-best-sleeping-bag-side-sleeper#close on Dec. 3, 2019.

* cited by examiner

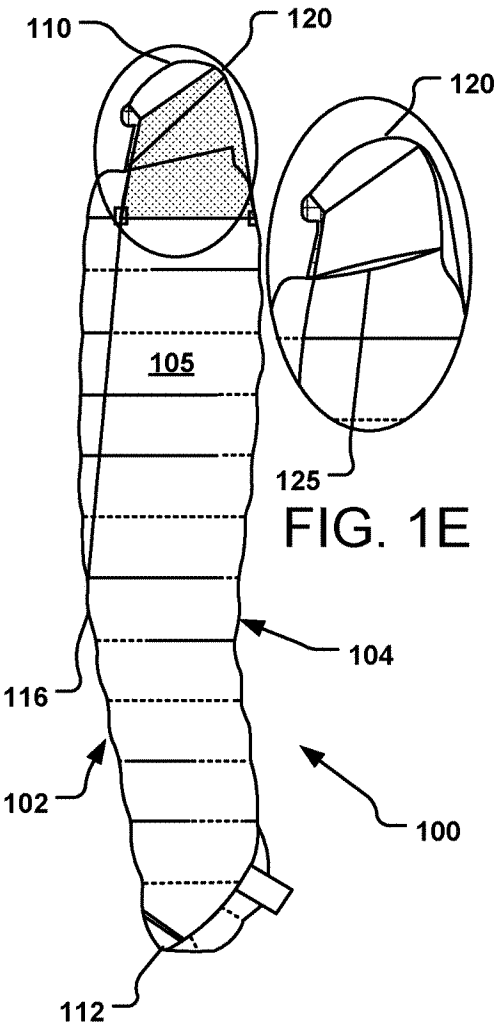
FIG. 1E
FIG. 1C
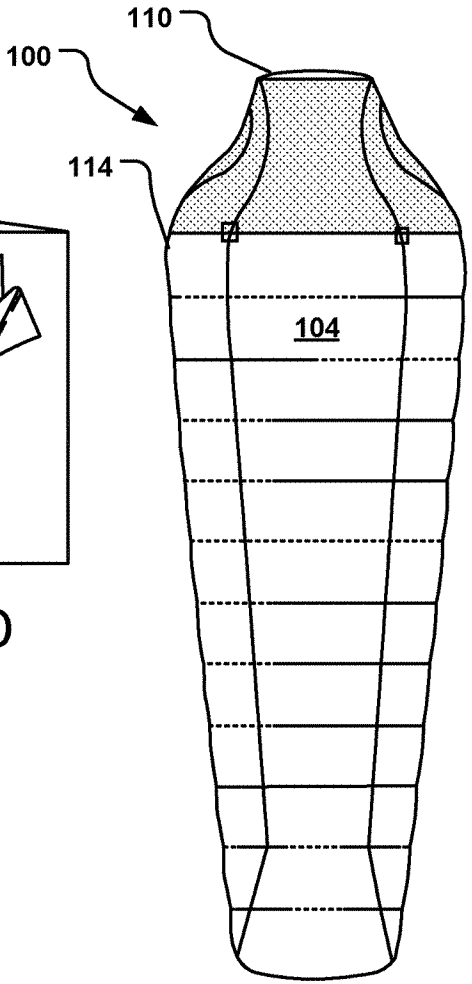
FIG. 1B
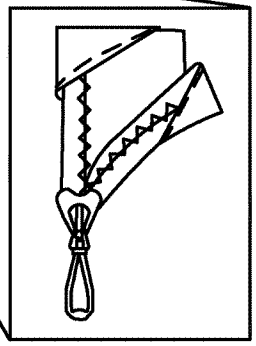
FIG. 1D
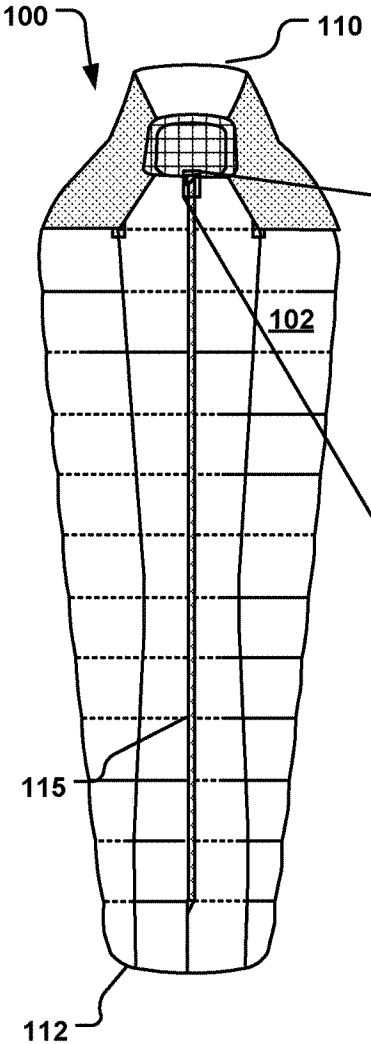
FIG. 1A

FIG. 8A
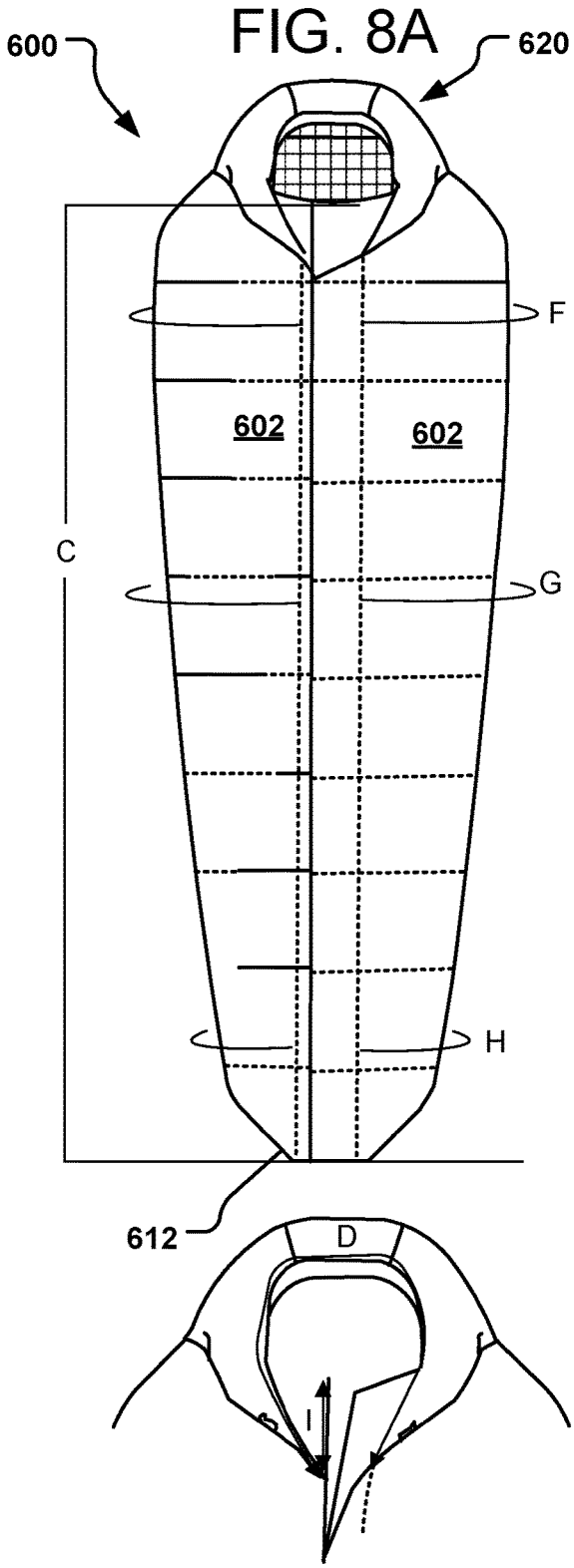
FIG. 8C
FIG. 8B
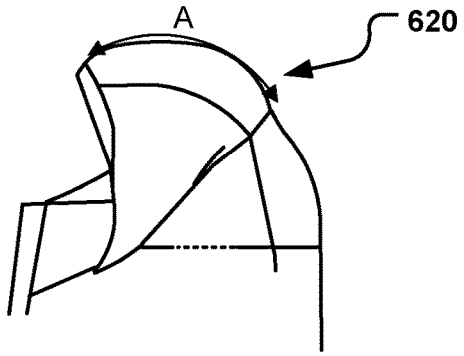
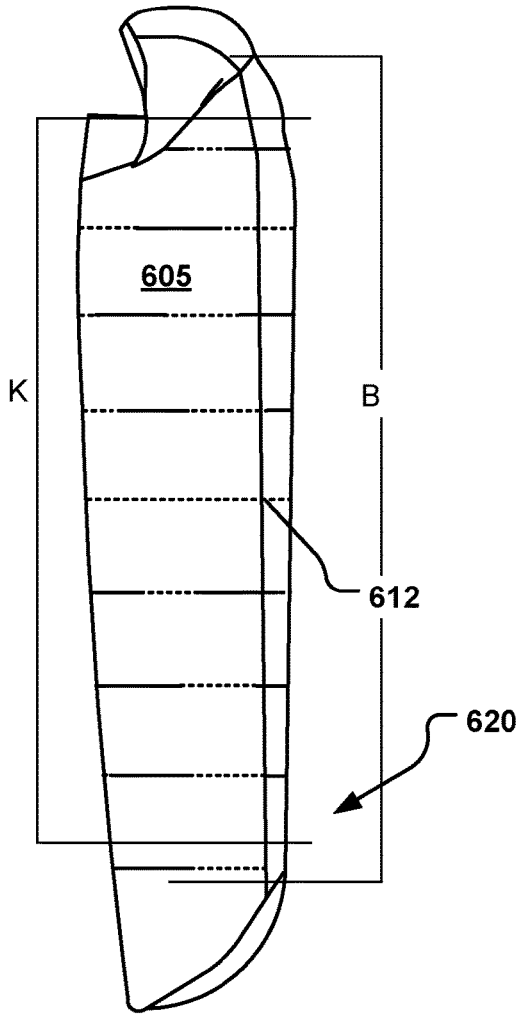
FIG. 8D

SIDE SLEEPER SLEEPING BAG

CROSS REFERENCE

This application claims priority to U.S. provisional application No. 63/146,061 filed Feb. 5, 2021 and titled Side Sleeper Sleeping Bag, the entire disclosure of which is incorporated herein by reference for all purposes.

BACKGROUND

Camping is currently enjoying a surge in popularity as the population, in general, is spending more time outdoors connecting with nature. There are many different ways in which people like to camp. Some campers carry their equipment to remote places and desire light and easily packed equipment, while at the other end of the spectrum, other campers 'camp' in established tents that have beds, electricity and many conveniences of a hotel (e.g., "glamping"). Between these two types of campers are those who camp alongside or close to their vehicles; these campers desire comfort without extravagance. No matter what type of camper, they have high desires for comfort and convenience while camping, and a large demand exists for products that can provide high levels of both.

For many campers, getting a good night's sleep can be difficult due to many different factors. Not only is the surface (e.g., cot, foam pad, blow-up pad, directly on the ground) upon which a camper sleeps very important in determining the level of comfort and the resulting quality of sleep, the physical comfort (e.g., due to lack of, or desired amount of, physical constraint) is paramount to sleeping well. Some campers enjoy being bundled tightly in a sleeping bag, whereas other desire move interior volume to allow for increased freedom of movement while in the sleeping bag.

Most sleeping bags are designed for a back-sleeper; however, the majority of the population is a side-sleeper. Attempting to sleep in traditional mummy style sleeping bag in a side position or fetal position can be very difficult and uncomfortable.

SUMMARY

The sleeping bags described herein are particularly designed for the side-sleeping user, being configured to inhibit twisting of the bag in relation to the user and remain centered in relation to the user's body. Thus, rather than the sleeping bag remaining in a flat position (the typical position for a back-sleeper) when the user rolls on their side, the sleeping bags described herein roll or otherwise move with the user when the user moves or re-adjusts position, allowing the user to remain comfortable and warm in the sleeping bag.

To achieve the desired fit, the hood and shoulder region of the sleeping bags are close fitting in comparison to other sleeping bags. Additionally, there is some articulation at the knee region to better follow the slightly bent shape that relaxed legs have when the user is sleeping on their side, and the footbox of the bags are pointed down to mimic a relaxed foot position. Further, additional insulation is provided on the sides of the bags proximate the locations of the shoulders and/or hips, to provide additional padding at these potential pressure points. For example, down or synthetic insulation can be used throughout the bag, with an increased amount of insulation (down or synthetic insulation, or both) present in specific areas, including the hip region, shoulder region, footbox or some combination of any or all of these locations.

In one particular implementation, this disclosure provides a sleeping bag having an increased amount of insulation in one or more of the hip region, the shoulder region, and the footbox. The sleeping bag may have two different types of insulation in the area having the increased amount of insulation versus one type of insulation in the other areas of the bag. The types of insulation may be based on the composition of the insulation (e.g., natural (e.g., down) versus synthetic) or the physical form of the insulation (e.g., lofty or batted).

In another particular implementation, this disclosure provides a sleeping bag having, when in a non-distorted or contorted position, having one or both of an articulated knee region and a tilted footbox. The knee region may be angled about 30 degrees to the back.

In yet another particular implementation, this disclosure provides a sleeping bag having a contoured hood that has perimeter and a face aperture that has a width that is about 25% of the hood perimeter.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. These and various other features and advantages will be apparent from a reading of the following Detailed Description.

BRIEF DESCRIPTIONS OF THE DRAWING

The disclosure may be more completely understood in consideration of the following detailed description of various embodiments of the disclosure in connection with the accompanying drawing, in which:

FIG. 1A is a front plan view of a sleeping bag according to the present disclosure; FIG. 1B is a back plan view of the sleeping bag; FIG. 1C is a side plan view of the sleeping bag; FIG. 1D is an enlarged perspective view of a portion of the zipper for the sleeping bag; and FIG. 1E is an enlarged side plan view of the hood of the sleeping bag.

Figures 5A, 5B, 5C:
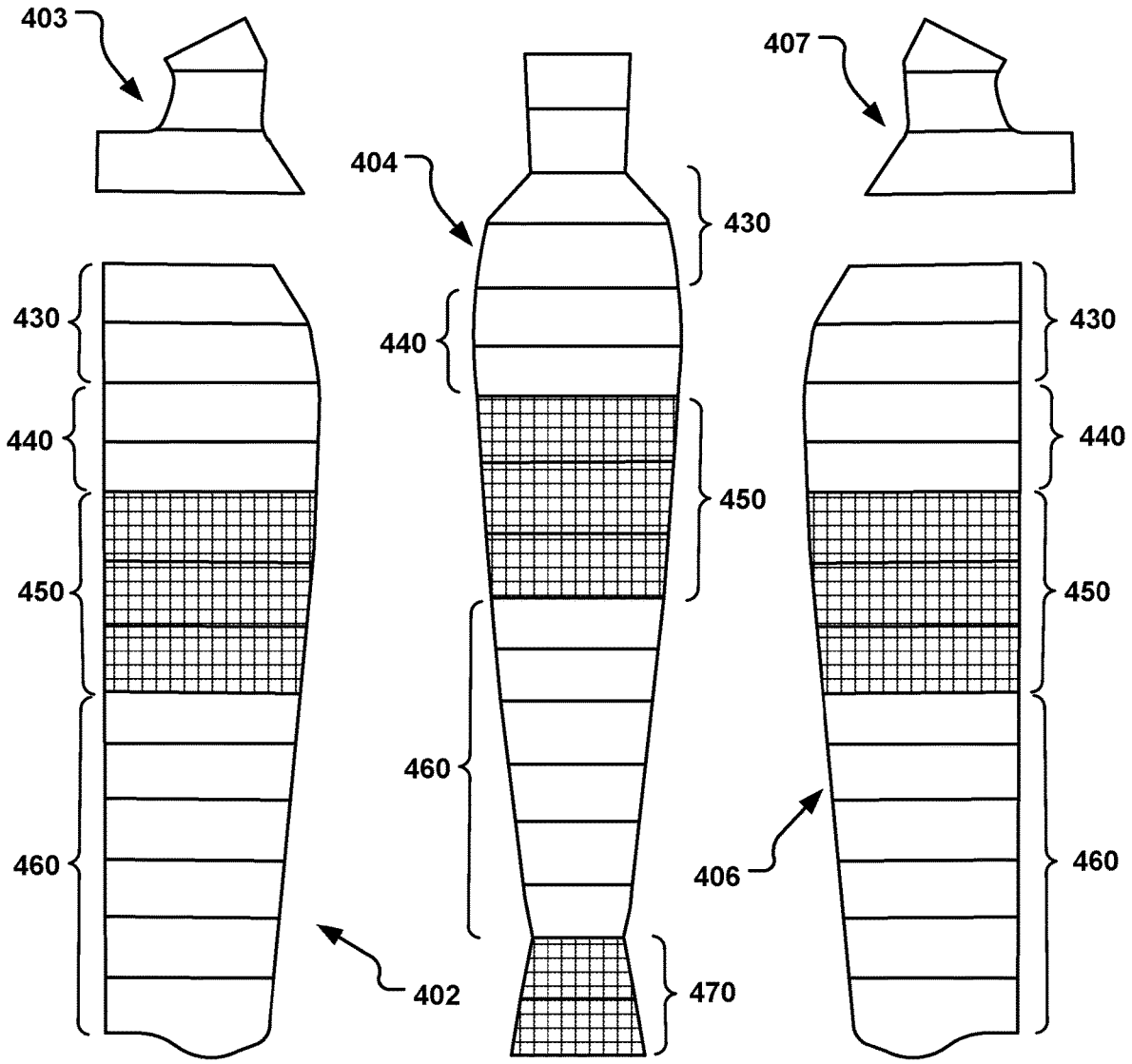
Figure 5D:
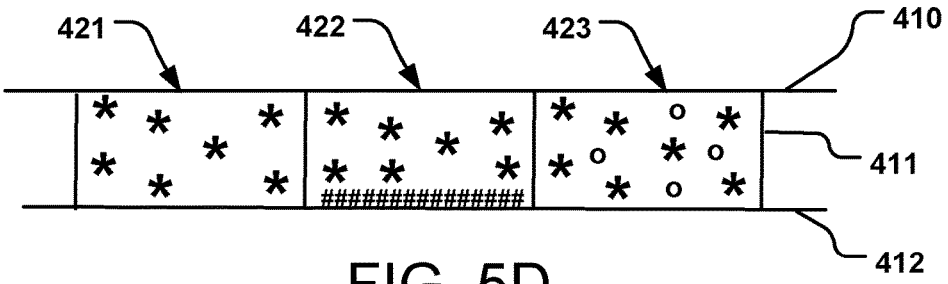

FIG. 5A is a plan view of panels of the left side of another sleeping bag according to the present disclosure showing relative insulation loading; FIG. 5B is a plan view of a panel of the back side of the sleeping bag showing insulation loading; FIG. 5C is a plan view of panels of the right side of the sleeping bag showing insulation loading; and FIG. 5D is a schematic side view of a plurality of baffles showing insulation loading.

Figure 6C:
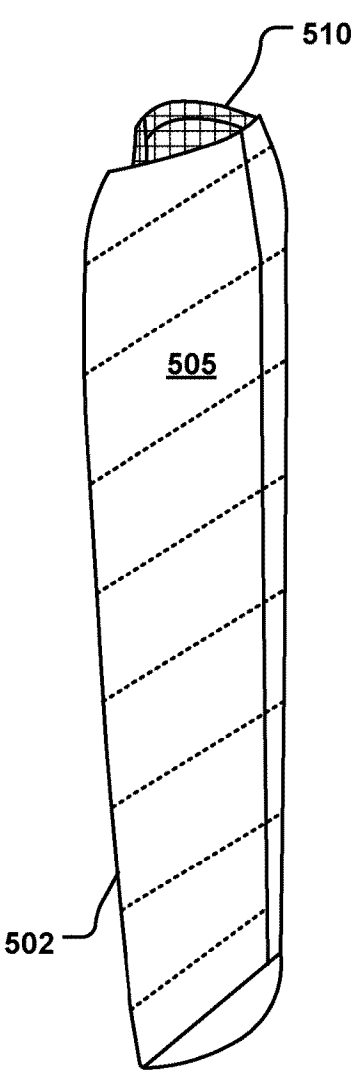
Figure 6B:
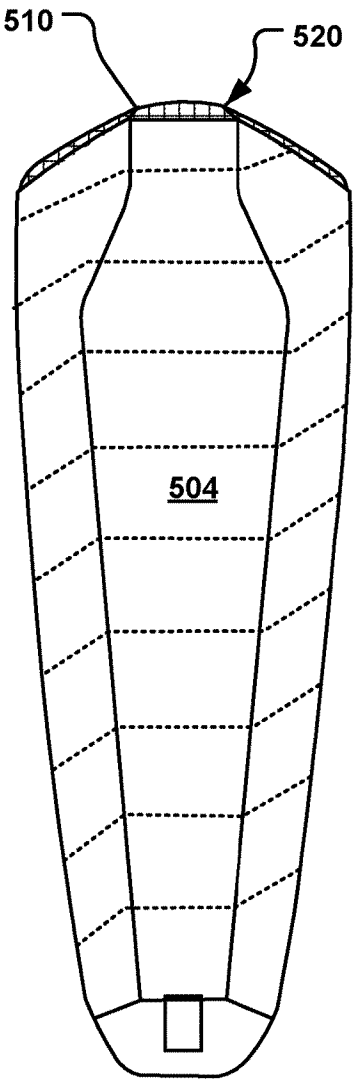
Figure 6D:
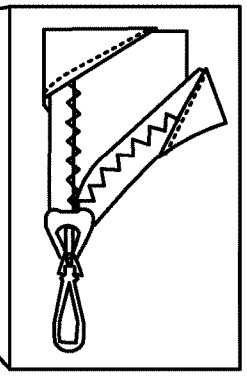
Figure 6A:
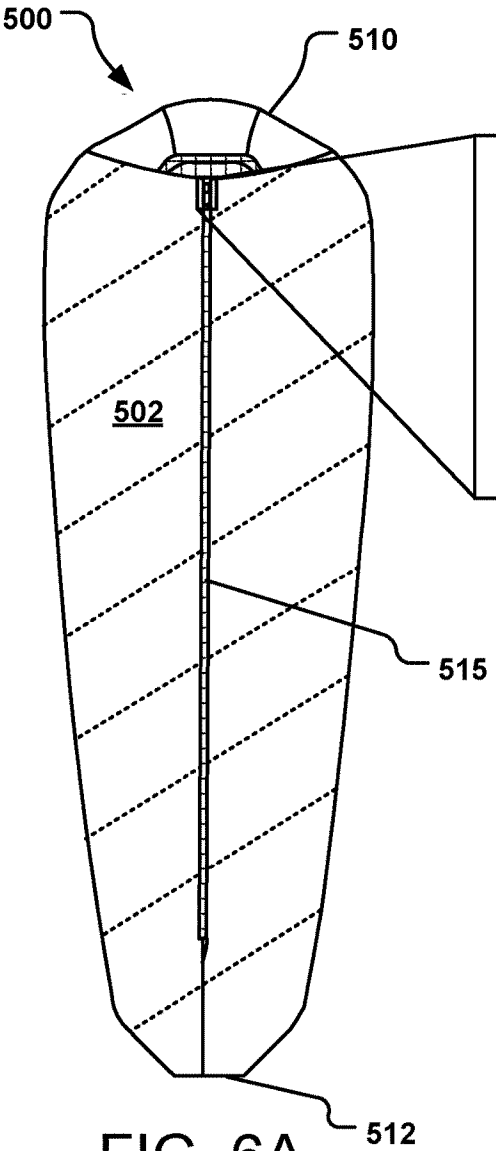

FIG. 6A is a front plan view of another sleeping bag according to the present disclosure; FIG. 6B is a back plan view of the sleeping bag; FIG. 6C is a side plan view of the sleeping bag; and FIG. 6D is an enlarged perspective view of a portion of the zipper for the sleeping bag.

Figure 7:
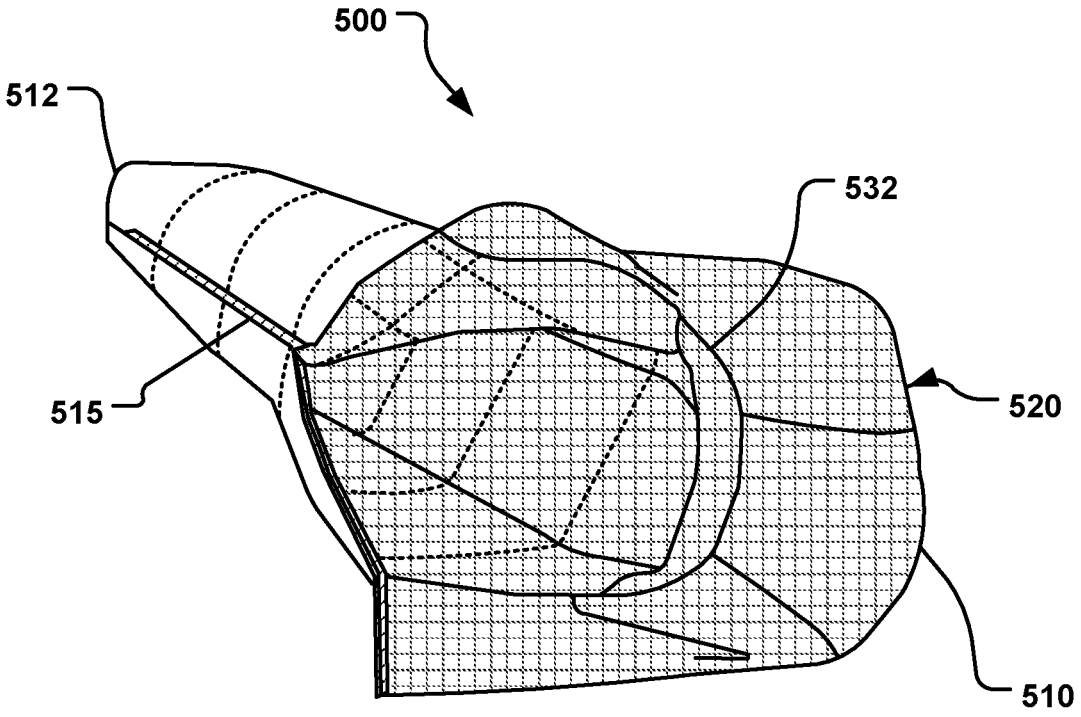

FIG. 7 is a perspective view of the sleeping bag of FIGS. 6A through 6D with a portion of the interior visible.

FIG. 8A is a front plan view of another sleeping bag according to the present disclosure; FIG. 8B is a side plan view of the hood of the sleeping bag; FIG. 8C is a front plan view of the hood of the sleeping bag; and FIG. 8D is a side plan view of the sleeping bag.

DETAILED DESCRIPTION

Traditional mummy sleeping bags are shaped for a human user sleeping on their back, in a supine or semi-supine position; however, more than 70% of people sleep on one of their sides, in a lateral position, for at least some portion of the night. People who enjoy sleeping in a traditional mummy shaped bag, in general, like to have the bag move with them as they re-adjust positions throughout the night.

The following description describes various embodiments of close fitting, mummy-style sleeping bags specifically designed and constructed for side-sleepers. The hood and shoulders are close fitting in comparison to other sleeping bags, while the hip region is generally looser and there is some articulation at the knee region to better follow the shape that relaxed legs make when someone is lateral, on their side. The footbox can be pointed down or slightly down to mimic a relaxed foot position. It is this unique fit of the bags that allows the bags to maintain their relative position to the user when the user rolls from their back to a side or from one side to another or in any other manner.

The sleeping bags include an extra layer or amount of insulation (e.g., synthetic insulation) at the hip and foot regions. Because a side sleeping person typically has more pronounced pressure at the hips and ankles due to having less surface area of the body contacting the sleeping surface, this extra insulation improves comfort by decreasing pressure on those points. The extra insulation, especially in the hip region, not only adds a little extra cushion to that area but also helps the overall bag perform better thermally.

Also, the bags described herein have a hood designed to inhibit twisting in relation to the user's head; as the user rolls to their side, the entire bag, including the hood, rotates with the user, rather than the user's head rotating inside the hood. The hood design also has an exterior hood pocket that can be accessed from the inside of the bag as well as from the outside. Because of this, the user can access and adjust a pillow (if one is being used) during the night without unzipping the bag and letting heat out of the sleeping bag. The pillow pocket can be made of stretch mesh to accommodate a larger pillow, which many side sleepers prefer during sleeping, e.g., to keep their spine in better alignment.

In the following description, reference is made to the accompanying drawing that forms a part hereof and in which are shown by way of illustration at least one specific embodiment. In the drawing, like reference numerals are used throughout several figures to refer to similar components. In some instances, a reference numeral may have an associated sub-label consisting of a lower-case letter to denote one of multiple similar components. When reference is made to a reference numeral without specification of a sub-label, the reference is intended to refer to all such multiple similar components.

Referring to FIGS. 1A, 1B and 1C, a sleeping bag 100 of a first overall design is shown. The sleeping bag 100 has a traditional mummy-style look, having a front side 102 (FIG. 1A) and an opposite back side 104 (FIG. 1B) and a left side 105 (FIG. 1C). The right side (not shown) is generally the same as the left side 105, with only a few minor differences, if any.

The sleeping bag 100 has a first end 110 at which the user's head is positioned (when the sleeping bag is properly in use) and a second end 112 at which the user's feet are positioned (when the sleeping bag is properly in use). The bag 100 has a generally tapered shape from the shoulder region 114 to the feet; that is, the second end 112 is narrower than the region 114 of the bag where the user's shoulders reside.

The sleeping bag 100 has a shell including a top sheet or panel and a bottom sheet or panel defining an interior volume to receive a user therein. In some designs, either or both the top sheet or panel and the bottom sheet or panel may be formed from multiple sheets or panels. Each of the sheets or panels is formed by an outer shell and an inner liner, with an amount of insulation therebetween. Baffles may be present between the shell and liner to control the distribution of insulation.

The insulation in the sleeping bag 100 may be any insulation suitable for sleeping bags, including natural insulation such as down and synthetic insulation such as polyester fill and insulations available under the tradenames POLARGUARD, POLARGUARD DELTA, QUALLOFIL, HOLLOFIL, THERMOLITE. It is noted that down, once compressed, loses much of its insulating capabilities, whereas synthetic insulation typically loses less when compressed.

The sleeping bag 100 has a zipper 115, seen in FIG. 1A, providing access to the interior of the sleeping bag 100. The zipper 115 is a conventional zipper, having two mating, elongate extensions, and may have a draft tube proximate thereto. In other designs, other closure mechanisms may be used, such as hook and loop fasteners.

At the first end 110 is a hood 120, connected to and extending from the shoulder region 114. The hood 120, where it connects to the shoulder region 114, extends the entire circumference of the bag; that is, where it connects to the shoulder region, the hood extends 360 degrees. Typically, the widest point of the bag 100 is where the hood 120 connects to the shoulder region 114.

The hood 120 includes an aperture 122 through which the user's face would be visible when the user is properly in the bag 100; the aperture 122 may be centered or may be offset. The zipper 115 extends to the aperture 122. The hood 120 and its shape are clearly seen from the side in FIG. 1C and FIG. 1E. FIG. 1D shows the zipper 115 and a draft tube proximate the aperture 122.

The hood 120 includes pocket that can be accessed from the inside of the bag as well as from the outside, the pocket present between the outer shell of the hood and an extension of material (e.g., stretchable mesh). The user can access and adjust an item in the pocket, such as a pillow, from the inside of the bag 100 without unzipping the bag. FIG. 1E shows the hood 120 and an exterior access 125 to the pocket.

In each of FIGS. 1A, 1B and 1C, the sleeping bag 100 is in a relaxed position, not being forced, biased, or contorted or distorted from its natural, relaxed position. In FIG. 1C it is seen that the bag 100 is not planar from the first end 110 to the second end 112, but has articulation at the knee region 116 to better follow the slightly bent shape that relaxed legs have when the user is sleeping on their side. This angle or articulation is at least about 15 degrees toward the back side 104, in some implementations about 20 to 40 or 45 degrees, and in other implementations about 30 degrees.

Another feature of the sleeping bag 100 is that the footbox (where the user's feet are positioned when the user is properly situated in the bag 100) at the second end 112 is pointed down, rather than ending flat. See, e.g., FIG. 1C, where it is seen that the length of the bag 100 proximate the location where the toes would rest is less than the length at the location where the heels would rest. Thus, when a user has their feet in the bag at the second end 112, the user is able to pivot the ankles and point their toes down unhindered, which is the natural position for relaxed feet.

Figure 2A:
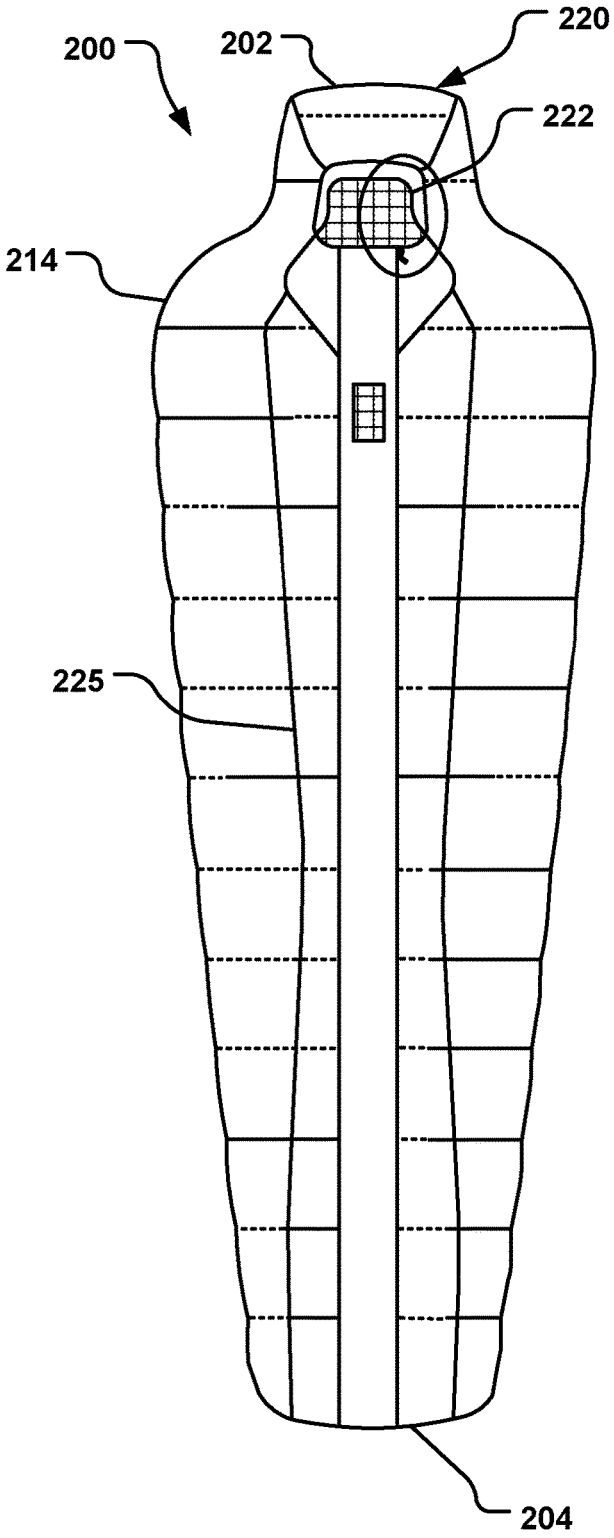
FIG. 2A is a front plan view of another sleeping bag according to the present disclosure.

FIG. 2A illustrates another example of a sleeping bag 200; it is noted that this bag 200 may have the same features as the sleeping bag 100 or may have different, additional, or less features. It is to be understood that various features and/or details from the sleeping bag 100 described above, may be applied to this sleeping bag 200 unless contrary to the construction.

FIG. 2A, however, shows the bag 200 from the inside out; thus, what is seen in FIG. 2A is the inner liner of the top sheet of the bag. The bag 200 has a first or hood end 202 and a second or foot end 204, with a shoulder region 214 therebetween. The bag 200 has an overall tapered configuration from the shoulder region 214 to the second end 204 at the footbox and has a hood 220 with a facial aperture 222 at the first end 202. The bag 200 has a zipper, which is hidden by a draft tube 225 in FIG. 2A; both the zipper and the draft tube 225 extend essentially the length of the bag, from the aperture 222 in the hood to the second end 204. A draft collar 230 is located proximate the draft tube 225 in the shoulder region 214 proximate the aperture 222.

Figure 2B:
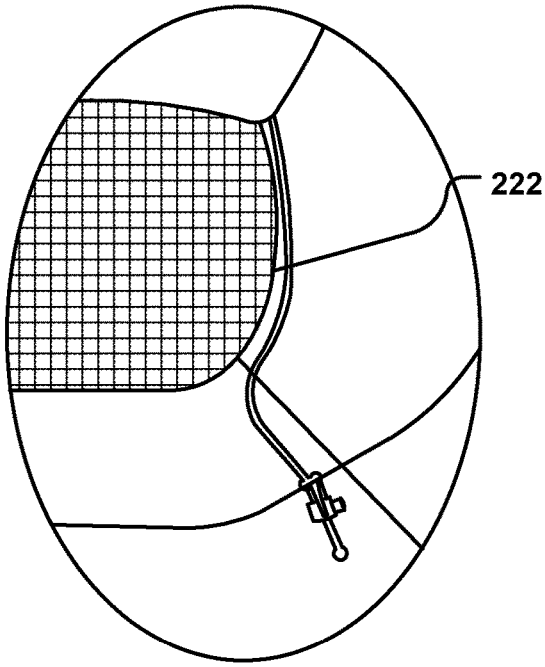
FIG. 2B is an enlarged view of a portion of FIG. 2A, emphasizing a portion of the hood structure.
Figure 3:
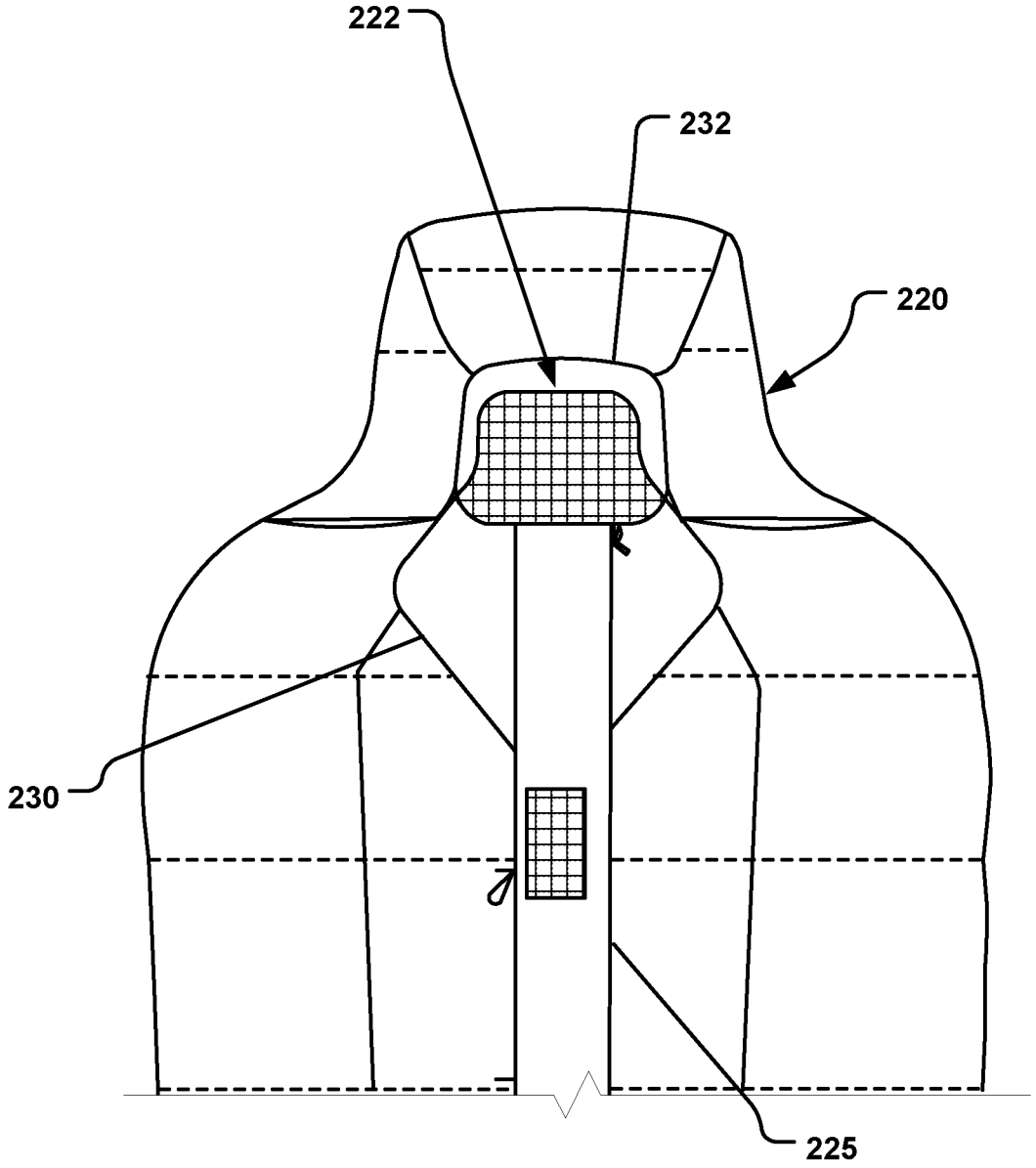
FIG. 3 is a front plan view of a portion of the sleeping bag of FIGS. 2A and 2B, emphasizing the hood structure and shoulder region of the bag.

Various details regarding the hood 220 and the aperture 222 are shown in FIG. 2B and FIG. 3. The hood 220 includes a draw string or shock cord extending at least partially around the hood aperture 222. In the particular design shown in FIG. 2B, one cord extends on each side (left side, right side) of the aperture 222, and not on the top side nor the bottom side of the aperture 222; in other designs, the location of the cord(s) may vary. The aperture 222 also includes a muff collar 232 (FIG. 3) around the aperture 222, to inhibit drafts from entering the hood 220 via the aperture 222 and optionally provide a sealing engagement with the user's face. Readily seen in FIG. 3, the muff 232 is continuous or integral with the draft collar 230.

In the illustrated design, the aperture 222 is centered in the hood, centered on the zipper 215. In other embodiments, the aperture can be offset to one side of the hood.

Figure 4A:
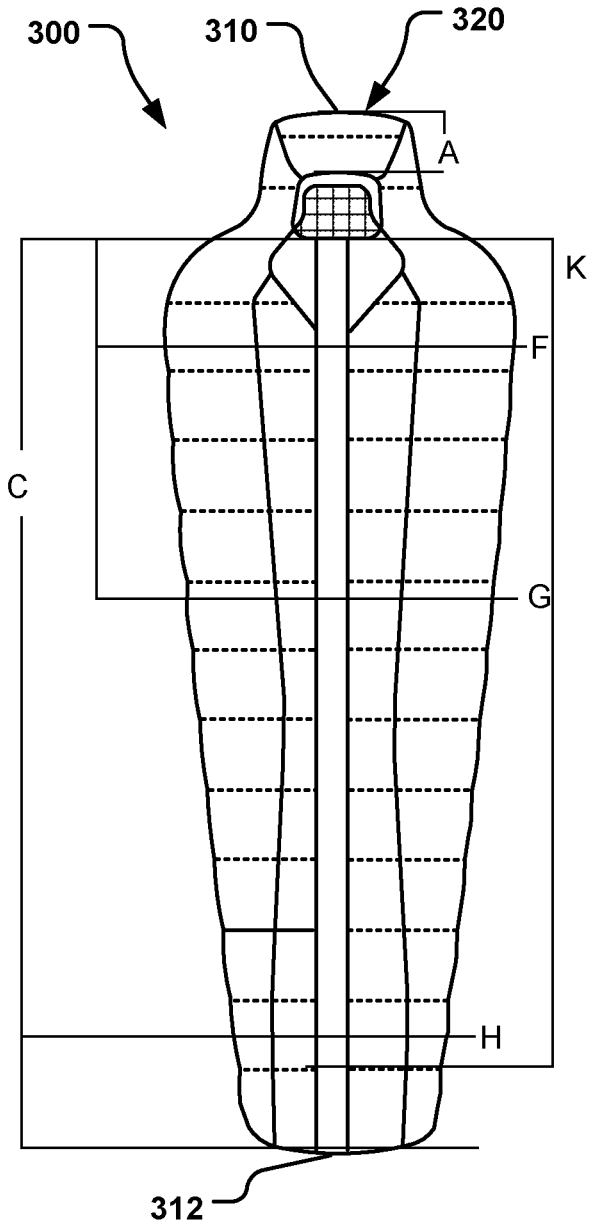
FIG. 4A is a front plan view of another sleeping bag according to the present disclosure having measurements indicated thereon.
Figure 4B:
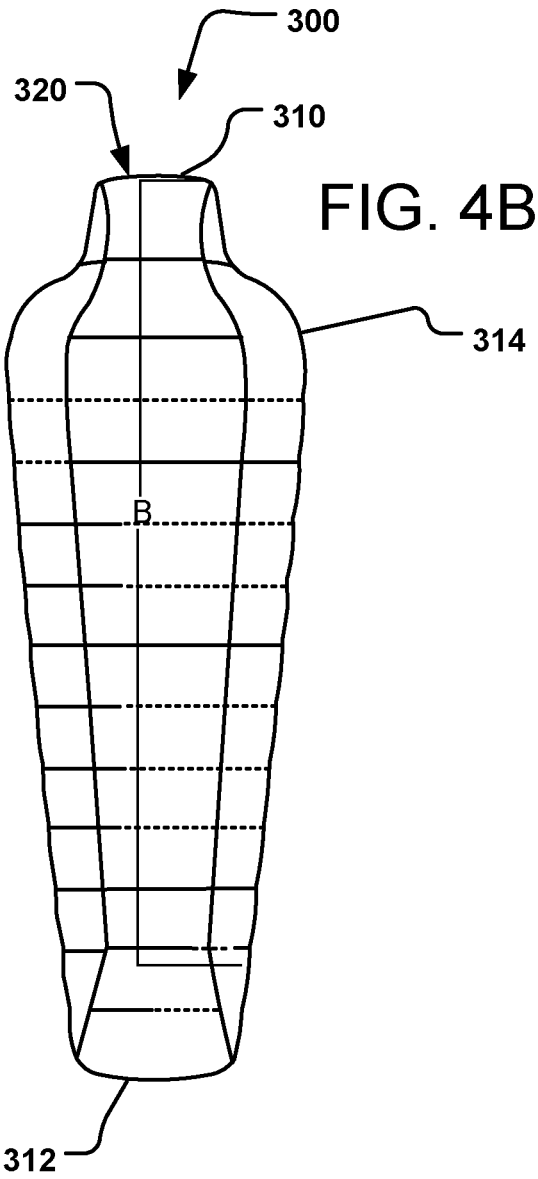
FIG. 4B is a back plan view of the sleeping bag having measurements indicated thereon.
Figure 4C:
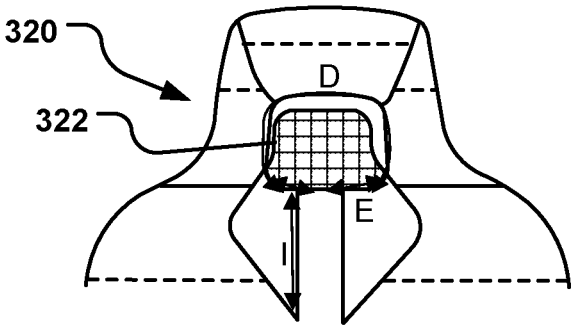
FIG. 4C is a front plan view of the hood portion of the sleeping bag having measurements indicated thereon.

Turning to FIGS. 4A, 4B and 4C, a sleeping bag 300 is shown, with various measurements called out in these figures. It is to be understood that various features and/or details from the sleeping bag 100, 200 described above, may be applied to this sleeping bag 300 unless contrary to the construction. Although all not called out in FIGS. 4A, 4B and 4C, the sleeping bag 300 has the features of the sleeping bags 100, 200, including a first or hood end 310, a second or foot end 312, an overall tapered form having a shoulder region 314, a hood 320 with a facial aperture 322, a foot box, and a draft tube and draft collar. It is noted that FIGS. 4A, 4B and 4C shows the bag 300 from the inside out; thus, what is seen in FIG. 4A is the inner liner of the top sheet of the bag 300 and the inner liner of the bottom sheet of the bag 300 is seen in FIG. 4B. The draft tube hides the full length zipper.

Table 1 below provides example of measurements for the example sleeping bag 300, that is particularly configured for a side sleeper.

TABLE 1

| | | inches |
|---|---|---|
| A | Hood Crown Height | 9 |
| B | Total Length | 80 |
| C | Top Sheet Length | 70 |
| D | Hood Opening Width - Top | 18 |
| E | Hood Opening Width - Bottom | 9½ |
| F | Shoulder Girth | 61 |
| G | Hip Girth | 55 |
| H | Foot Girth | 36 |
| I | Draft Collar Height - Center | 6 |
| K | Zipper Length | 65 |

where:

(A) Hood Crown Height: Measured from eye muff seam to hood crown seam (seam should be at the given measurement)

(B) Total Length: Measured from hood crown height seam straight along center back of bag to the back of the footbox. The back of the footbox is measured back from the front footbox seam; example footbox lengths are 10.5 inches and 11 inches.

(C) Top Length: Measured from lower hood opening seam to front foot box seam along center of top sheet.

(D) Hood Opening Width—Top: Measured along top edge of hood opening from seam to seam.

(E) Hood Opening Width—Bottom: Measured along both sides of the bottom edge of hood opening from seam to edge, not including zipper.

(F) Shoulder Girth: Circumference of bag, measured at shoulder, not including zipper. The shoulder point is the total top sheet minus 10 inches.

(G) Hip Girth: Circumference of bag, measured at hip, not including zipper. The hip point is half the total top sheet length.

(H) Foot Girth: Circumference of bag, measured at foot, not including zipper. The foot point is measured 7 inches up from the foot box seam.

(I) Draft Collar Height—Center Zipper: Measured at edge of collar at seam nearest zipper.

(J) Zipper Length: Measured along edge of main zipper, while bag is unzipped.

In this example implementation, the hood aperture (e.g., the aperture 322 in FIG. 4C) has a perimeter of 27½ inches (not listed in Table 1) and the shoulder region 314 has a maximum girth of 61 inches, defining a ratio of about 1:2.2, or, about 45%. The width of the hood aperture (i.e., aperture bottom (E), 9½ inches) to the width in the shoulder region 314 (i.e., half of (F), 30.5 inches) is about 1:3.2, or, about 31%. The width of the hood aperture (i.e., aperture bottom (E), 9½ inches) to the aperture perimeter (i.e., 27½ inches) is about 1:2.9 or 3, or, about 33-34%.

Not indicated in Table 1, the overall periphery or circumference of the hood 320 (when measured about the neck at the same level of the aperture bottom (E)) is about 36 inches; thus, the ratio of the neck circumference to the aperture width E is about 1:3.8, or, about 26%. Thus, the hood 320 occupies about 74% of the distance or perimeter around the neck.

In other implementations, the ratio of the hood aperture perimeter to the shoulder girth is about 1:1.75 to about 1:2.5, or, about 55% to about 40%; the ratio of the hood aperture width to the shoulder width is about 1:2.75 to about 1:3.5, or, about 36% to about 28%; and the overall circumference of the hood to the hood aperture width is about 1:3.5 to about 1:5, or, about 28% to about 20%, e.g., about 25%.

In other implementations, the width of the hood aperture is about 20%-40% of the perimeter of the aperture, e.g., about 25%.

FIGS. 5A, 5B and 5C illustrate details of the insulative construction of an example side-sleeping sleeping bag; shown are the panels used for the construction of the sleeping bag. The front side of the sleeping bag is formed by a left side panel 402 (FIG. 5A), a back panel 404 (FIG. 5B) and a right side panel 406 (FIG. 5C) that are connected (e.g., sewn) together to form the bag. The sleeping bag has a hood formed from a left side hood panel 403 (FIG. 5A) and a right side hood panel 407 (FIG. 5C). As with the other sleeping bags disclosed herein, the sleeping bag resulting from these panels 402, 403, 404, 406, 407 has a hood at the first or top end at which the user's head is positioned (when the sleeping bag is properly in use) and a second or bottom end at which the user's feet are positioned (when the sleeping bag is properly in use). The bag has a generally tapered shape from the shoulder region to the second end.

Turning to FIG. 5D and as indicated above, the panels 402, 403, 404, 406, 407 are formed by an outer shell 410 and an inner liner 412 with an amount of insulation therein. Extending between the shell 410 and liner 412 are a plurality of walls 411 defining individual baffles 421, 422, 423. In FIGS. 5A, 5B and 5C, the baffles extend essentially perpendicular to the length of the bag from the first end to the second end, whereas in other designs the baffles may run in different direction(s). The walls 411 may be made via an extension of material present between the shell 410 and liner 412 or may be merely a connection (e.g., stitching) directly connecting the shell 410 and liner 412, forming a quilted construction.

It is not uncommon, in current day sleeping bags, to have a gradient of insulation in the bag, with more insulation present in the torso region than in the leg region, since the torso is where the greatest amount of body mass is located. The side sleeper sleeping bags of this disclosure, however, increase the amount of insulation present in the hip region of the bag, the shoulder region of the bag, and/or the footbox, compared to the overall torso region. All of these regions commonly have increased pressure points on the user when the user sleeps on their side; the increased amount of insulation present in these regions decreases the pressure points and increases user comfort. In the panels 402, 404, 406 of FIGS. 5A, 5B and 5C, called out are the shoulder region 430, the torso region 440, the hip region 450, the leg region 460 and footbox 470. It is understood that these delineations of the regions are a generalization and will differ based on the number of baffles, the size and shape of the bag, etc.

In the panels 402, 404, 406 of FIGS. 5A, 5B, 5C, an increased amount of insulation is present in the hip region 450 and the footbox 470, identified by the hatched baffles in the figures. In this particular example, in the side panels 402, 406, from the neck (where the hood panels 403, 407 attach to the side panels 402, 406) to the footbox (but not including the footbox), are thirteen essentially even height baffles (the height measured in a direction from the neck to the footbox). Shown are three (hatched) baffles in the hip region 450, which have an increased amount of insulation compared to the standard baffles in the shoulder region 440, the torso region 450 and the leg region 460. Both baffles of the footbox 470 have increased insulation, as seen in FIG. 5B.

FIG. 5D illustrates two examples of baffles having increased insulation. In FIG. 5D, the first baffle 421 has a standard amount of insulation, the second baffle 422 has an increased amount of insulation due to the standard amount of insulation being present as well as a batt of insulation, and the third baffle 423 also has an increased amount of insulation (compared to the first baffle 421) due to the standard amount of insulation being present as well as additional insulation. When it is said that the amount of insulation "is increased," or "an increased amount of insulation," or the like, what is intended is that the increase is based on a volume basis (e.g., grams/cc or grams/$cm^3$ or grams/$m^3$) of the insulation. Additional examples are provided below.

As an example, the amount of insulation in each baffle in the hip region may be, e.g., at least 20% more than the adjacent baffle that is not in the hip region and that does not have increased insulation. In other examples, the amount of insulation is at least 25% more, or at least 30% more, or at least 40% more.

As another example, the amount of insulation in each baffle in the shoulder region may be, e.g., at least 15% more than the adjacent baffle that is not in the hip region and that does not have increased insulation. In other examples, the amount of insulation is at least 20% more, or at least 25% more. Similar insulation values can be applied to the footbox.

Similar increased insulation values can be applied to the footbox.

The increase in insulation per volume may be the same in the three regions (hips, shoulder, footbox, depending on which regions have the increased insulation) or may differ. For example, some designs have more insulation in the hip region than the shoulder region. Additionally, the insulation amount may differ based on the location in the region. For example, the hip region of the side panels 402, 406 may have more of an increase in insulation than the hip region of the back panel 404.

The insulation throughout the bag may be, e.g., down or synthetic, or a combination thereof, and may be lofty, loose, or in the form of batts or matts, woven or nonwoven. The additional insulation (added in one or more of the hip region, the shoulder region, or the footbox) may be down, synthetic, or a combination thereof; it may be the same as the standard insulation, thus merely increasing the amount of that insulation, or it may be a different insulation. The added insulation can be loose insulation or may be a batt or matt of insulation, that could be adjacent to the outer shell or to the inner liner, or dispersed throughout the standard insulation.

In one particular embodiment, for the increased insulation baffles, a batt of synthetic insulation is adjacent to the outer shell, separated from lofty down insulation by a scrim material, whereas the standard baffles have solely down insulation. The amount of lofty down insulation is consistent or constant across all baffles.

In another particular embodiment, for the increased insulation baffles, a batt of natural insulation (such as wool, yak fiber, alpaca fiber) is adjacent to the outer shell, optionally separated from lofty insulation by a scrim material, whereas the standard baffles have solely lofty insulation. The amount of lofty insulation is consistent or constant across all baffles. Such an embodiment may be similar to the baffle 422 compared to the baffle 421 of FIG. 5D.

In another particular embodiment, for the increased baffles, loose synthetic insulation is dispersed with down insulation, whereas the standard baffles have only down insulation, at the same amount across all baffles. Such an embodiment may be similar to the baffle 423 compared to the baffle 421 of FIG. 5D.

In another particular embodiment, for the increased baffles, more insulation (e.g., lofty) is present in the baffles, compared to the standard baffles which have less of the same (e.g., lofty) insulation.

In yet another particular embodiment, for the increased insulation baffles, a thicker batt of synthetic insulation is adjacent to the outer shell, whereas the standard baffles have a thinner batt of synthetic insulation.

This overall design of the embodiments of FIGS. 1A through 5C, having a contoured hood, has increased insulation in the hip region, the shoulder region and/or in the footbox, an articulated knee region, and a tilted footbox with increased insulation. This design moves with the sleeper (user) in the bag when the sleeper twists or rotates.

Turning to FIGS. 6A through 7, a second overall design of side sleeper sleeping bag is shown, and a third overall design of a side sleeper sleeping bag is shown in FIGS. 8A through 8D. These sleeping bags of FIGS. 6A through 8D have the same general shape as the bags of FIGS. 1A through 5C in the body, however these have a larger girth and a more relaxed fit. The hood is different, being more of a shroud, relaxed and combined with the draft collar, so that it can tuck around the user's face, similar to a blanket, whereas the first designs have a closer fitting hood. The hood is large enough to hold a pillow inside the hood, without a pillow pocket, e.g., on the exterior of the hood. It is to be understood that various features and/or details from the sleeping bags 100, 200, 300 described above, may be applied to these sleeping bags unless contrary to the construction.

Referring to FIGS. 6A, 6B, 6C and 7, another side sleeper sleeping bag 500 is shown. The sleeping bag 500 has a front side 502 (FIG. 6A) and an opposite back side 504 (FIG. 6B) and a left side 505 (FIG. 6C). The right side is generally the same as or similar to the left side 505, with only a few minor differences, if any.

As with the previous design and implementations, the sleeping bag 500 has a first end 510 at which the user's head is positioned (when the sleeping bag is properly in use) and a second end 512 at which the user's feet are positioned (when the sleeping bag is properly in use). The bag 500 has a generally tapered shape from the shoulder region to the feet; that is, the second end 512 is narrower than the region of the bag where the user's shoulders reside when the user is properly in the sleeping bag. The sleeping bag 500 has a shell including a top sheet and a bottom sheet defining an interior volume to receive a user therein. Each of the sheets is formed by an outer shell and an inner liner, with an amount of insulation therebetween. Baffles may be present between the shell and liner to control the distribution of insulation.

The insulation in the sleeping bag 500 may be any insulation suitable for sleeping bags, including natural insulation such as down and synthetic insulation such as polyester fill and insulations available under the tradenames POLARGUARD, POLARGUARD DELTA, QUALLOFIL, HOLLOFIL, THERMOLITE. It is noted that down, once compressed, loses much of its insulating capabilities, whereas synthetic insulation loses less when compressed.

The sleeping bag 500 has a zipper 515, seen in FIG. 6A, to provide access to the interior of the sleeping bag 500. The zipper 515 is a conventional zipper, having two mating, elongate extensions, and may have a draft tube proximate thereto.

At the first end 510 is a hood 520, shown in FIG. 6A in a relaxed position, with no tension or force on it. Unlike the previous side sleeper bag designs, the hood 520 is less structured and more relaxed, similar to a shroud. The hood 520 is combined with the draft collar, so that it can tuck around the user's face, similar to a blanket; see, e.g., FIG. 6D for details of a draft collar. The hood 520 includes an aperture through which the user's face would be visible when the user is in the bag 500.

The footbox at the second end 512 of the sleeping bag 500 is pointed down; see, e.g., FIG. 6C, where it is seen that the length of the bag proximate the toe location is less than at the heel location. Thus, when a user has their feet in the bag 500 at the second end 512, the user is able to pivot the ankles and point their toes down, which is the natural position for relaxed feet.

FIG. 7 shows the interior of the sleeping bag 500, with the zipper 515 partially unzipped. In this orientation, the hood 520 is splayed open, with a cowl-like draft collar 532 seen.

This sleeping bag 500, having the more relaxed or shroud-like hood, has increased insulation at least in the hip region and in the footbox. As with the sleeping bags 100, 200, 300, this design moves with the sleeper (user) in the bag when the user twists or rotates.

Turning to FIGS. 8A, 8B, 8C and 8D which show another example side sleeper sleeping bag 600, various measurements are called out in these figures. Table 2 below provides one example of measurements for the sleeping bag 600, the measurements being taken the same as in Table 1. As with the previous implementations of bags described above, the sleeping bag 600 has a front side 602 (FIG. 8A), an opposite back side (not shown), a left side 605 (FIG. 8D) and a right side (not shown) that is essentially the same as or similar to the left side. The sleeping bag 600 has a first end at which the user's head is positioned (when the sleeping bag is properly in use) and a second end 612 at which the user's feet are positioned (when the sleeping bag is properly in use). The bag 600 has a generally tapered shape from the shoulder region to the second end 612. The sleeping bag 600 has a top sheet and a bottom sheet defining an interior volume to receive a user therein and has an elongate zipper to provide access to the interior of the sleeping bag 600. In this design an overlap flap covers the zipper on the front side 602. At the first end is a hood 620 having an aperture for emergence of or access to a user's face.

TABLE 2

| | | inches |
|---|---|---|
| A | Hood Crown Height | 11½ |
| B | Total Length | 80 |
| C | Top Sheet Length | 74 |
| D | Hood Opening Width - Zipper to Zipper | 32½ |
| E | Hood Opening Width - Bottom | 9½ |
| F | Shoulder Girth | 62 |
| G | Hip Girth | 58 |
| H | Foot Girth | 38 |
| I | Draft Collar Height - at Zipper | 6 |
| J | Zipper Length | 65 |

This design, having the more relaxed hood, has increased insulation (e.g., synthetic insulation) in the hip region and in the footbox. As with the sleeping bags 100, 200, 300, this second design moves with the sleeper (user) in the bag when the sleeper twists or rotates.

The above specification, together with the figures, provides a complete description of the structure and use of exemplary embodiments of the invention. The above description provides specific implementations. It is to be understood that other implementations and embodiments are contemplated and may be made without departing from the scope or spirit of the present disclosure. The above detailed description, therefore, is not to be taken in a limiting sense. For example, the sleeping bag may be a "mummy" style bag having an integrated hood (as disclosed herein), a bag tapering in width from the first (head) end to the second (foot) end (as disclosed), or may be rectangular while still incorporating the features described herein (one or more of, e.g., increased insulation in the hip or shoulder region, articulate knee region, tilted footbox, encompassing hood). While the present disclosure is not so limited, an appreciation of various aspects of the disclosure will be gained through a discussion of the examples provided.

As used herein, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower", "upper", "beneath", "below", "bottom", "above", "on top", "top", etc., if used herein, are utilized for ease of description to describe spatial relationships of an element(s) to another. Such spatially related terms encompass different orientations of the device in addition to the particular orientations depicted in the figures and described herein. For example, if a structure depicted in the figures is turned over or flipped over, portions previously described as below or beneath other elements would then be above or over those other elements.

Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A sleeping bag having a first end and an opposite second end, and between the first end and the second end a shoulder region, a torso region, a hip region, a leg region, a knee region, and a footbox at the second end, with an increased amount of insulation in one or more of the hip region, the shoulder region, and the footbox, compared to the torso region and the leg region.

2. The sleeping bag of claim 1 wherein the increased amount of insulation is at least 15% by weight per volume more.

3. The sleeping bag of claim 2 wherein the increased amount of insulation is at least 20% by weight per volume more.

4. The sleeping bag of claim 1 wherein the one or more of the hip region, the shoulder region, and the footbox comprises two different types of insulation, compared to the torso region and the leg region that comprise one type of insulation.

5. The sleeping bag of claim 4 wherein the two different types of insulation are natural and synthetic insulation.

6. The sleeping bag of claim 4 wherein the two different types of insulation are lofty and batt insulation.

7. The sleeping bag of claim 6, wherein the sleeping bag comprises an inner liner and an outer shell, with the batt insulation between the inner liner and the outer shell adjacent to the outer shell.

8. The sleeping bag of claim 1, when in a non-distorted or contorted position, the knee region is an articulated knee region.

9. The sleeping bag of claim 8, wherein the articulated knee region is angled about 30 degrees.

10. The sleeping bag of claim 1 further comprising a contoured hood at the first end, the hood having an overall perimeter and a face aperture that has a width that is about 25% of the overall perimeter.

11. A sleeping bag comprising a top panel and a bottom panel, each of the top panel and the bottom panel having an inner liner and an outer shell, with insulation between the inner liner and the outer shell, the sleeping bag having a shoulder region, a torso region, a hip region, a leg region, and a footbox, wherein one or more of the hip region, the shoulder region, and the footbox has more insulation weight per volume than the torso region and the leg region.

12. The sleeping bag of claim 11, wherein the hip region has more insulation per volume than the torso region and the leg region.

13. The sleeping bag of claim 11 wherein the one or more of the hip region, the shoulder region, and the footbox has at least 15% more insulation.

14. The sleeping bag of claim 13 wherein the one or more of the hip region, the shoulder region, and the footbox has at least 20% more insulation.

15. The sleeping bag of claim 11 wherein the one or more of the hip region, the shoulder region, and the footbox comprises two different types of insulation, compared to the torso region and the leg region that comprise one type of insulation.

16. The sleeping bag of claim 15 wherein the two different types of insulation are natural and synthetic insulation.

17. The sleeping bag of claim 11 further comprising a knee region, when in a non-distorted or contorted position, the knee region is an articulated knee region.

18. The sleeping bag of claim 17, wherein the articulated knee region is angled about 30 degrees.

19. The sleeping bag of claim 11 further comprising a contoured hood having an overall perimeter and a face aperture that has a width that is about 25% of the overall perimeter.

* * * * *